United States Patent [19]

Kennedy

[11] Patent Number: 4,830,363

[45] Date of Patent: May 16, 1989

[54] DRY LAND SWIMMING TRAINING APPARATUS

[76] Inventor: Robert J. Kennedy, 2373 Urbandale Drive, Ottawa, Ontario, Canada, K1G 3G5

[21] Appl. No.: 152,460

[22] Filed: Feb. 5, 1988

[51] Int. Cl.[4] ..... A63B 31/00; A63B 69/10

[52] U.S. Cl. ..... 272/71; 434/254

[58] Field of Search ..... 272/70, 71, 72, 73, 272/97, 128, 130, 132, 144, 134; 128/25 R; 434/254

[56] References Cited

U.S. PATENT DOCUMENTS

| | | | |
|---|---|---|---|
| 3,074,716 | 1/1963 | Mitchel et al. | 128/25 R |
| 3,810,614 | 5/1974 | Hessburg | 272/117 |
| 4,575,077 | 3/1986 | Osborne et al. | 272/144 |
| 4,620,701 | 11/1986 | Mojden | 272/144 |
| 4,674,740 | 6/1987 | Iams et al. | 272/71 |
| 4,709,918 | 12/1987 | Grinblat | 272/97 |

*Primary Examiner*—Richard J. Apley
*Assistant Examiner*—S. R. Crow
*Attorney, Agent, or Firm*—Burke-Robertson

[57] ABSTRACT

A portable, adjustable apparatus for dry land swimming training is disclosed. The apparatus comprises a frame supporting a bench on which the torso of a user can be supported in generally horizontal position, lever means secured to the frame behind the bench to supportably receive the user's legs, the lever means being moveable upon movement of the user's legs, and arm movement means secured to the frame for gripping by the user's hands to permit swimming-like movement of the user's arms. The arm movement means consists of a pair of retractable cords. A hand grip means is secured to one end of each cord and the other end of each cord is secured to a retractable pulley means. The bench has associated therewith means to adjust upwardly or downwardly the midsection of the bench with respect to the rest thereof. The apparatus according to the present invention is fully adjustable to different sizes of users, and provides a strengthening workout or an endurance workout under controlled conditions, while at the same time providing a simulation of forces exerted on a person swimming in the water.

13 Claims, 1 Drawing Sheet

DRY LAND SWIMMING TRAINING APPARATUS

BACKGROUND OF THE INVENTION

The present invention relates to a dry land swimming training apparatus, and more particularly relates to such an apparatus which can provide a strengthening workout or an endurance workout to a user while simulating the forces on and movements of a person swimming in water.

The present invention relates to an improvement in conventional swimming training apparatus of the type having a frame, a bench secured to the frame to support the torso of the user in generally horizontal position above a supporting surface, level means secured to the frame behind the bench to supportably receive the user's legs and permit swimming-like motion thereof and arm movement means secured to the frame for gripping by the user's hand to permit swimming-like (simulated-swim) motion thereof.

Such a conventional device is described and illustrated in U.S. Pat. No. 3,074,716 of Mitchel et al issued Jan. 22, 1963. This device comprises a relatively complicated arrangement for instructing swimming and for exercising, providing a bench to support a user in horizontal position and arm and leg movement levers mechanically secured to a frame beneath the bench. The arm movement means consists of a crank mechanism which pivots about a central axis, one such mechanism being provided for each arm. U.S. Pat. No. 3,810,614 of Hessburg issued May 14, 1974, describes and illustrates a swimming training device having a bench on which a user is supported, and ropes, at one end of which are weights offering weight resistance for the user's arms and legs, and at the other end of which are means for gripping by user's hands or securing about a user's legs. U.S. Pat. No. 4,537,396 of Hooper issued Aug. 27, 1985, describes an exercise machine using pulleys to provide resistance for the user's arms. Hopkins U.S. Pat. No. 4,422,634 issued Dec. 27, 1983, features a swimming simulator of the general type in question in which an air pump or a compressor offers resistance to the movement of levers to be moved by the user's legs. U.S. Pat. No. 4,674,740 of Iams issued June 23, 1987, describes and illustrates an exercise machine for simulating swimming motions having a bench, arm cranks and leg support means, the latter permitting limited motion of the thighs in a flutter kick movement. Resistance to the movement of the leg support means is provided by, for example, piston means.

Other patents of general background interest describing and illustrating swimming motion training apparatus, in which lever arms or the like emulate and coordinate both arm and leg movement, as well as possibly body movement, include U.S. Pats. Nos. 2,013,520 of McDermott issued Sept. 3, 1935, U.S. Pat. No. 2,019,224 of Hess issued Oct. 29, 1935, U.S. Pat. No. 2,109,775 of Hudson issued Apr. 9, 1985 and U.S. Pat. No. 1,990,124 of Kabisius issued Feb. 3, 1935. Other swimming instruction or swimming exercise devices, of general background interest are described and illustrated in Becker U.S. Pat. No. 2,497,391 issued Feb. 14, 1950, Andrews U.S. Pat. No. 3,731,921 issued May 8, 1973 and U.S. Pat. No. 3,791,646 issued Feb. 12, 1974. U.S. Pat. Nos. 4,183,520 issued Jan. 15, 1980 and U.S. Pat. No. 4,509,746 issued Apr. 9, 1985 teach exercise apparatus of a more general nature.

All of these prior art devices, even though often designed specifically for swimming exercises or training, are deficient in one or more ways. For example, the benches for torso support may be completely flat and uncomfortable and potentially injurious to the user in the performance of certain swimming movements. The motion permitted by the arm movement means may be restricted by the crank mechanism. The apparatus may not be adjustable to different sizes of persons, or only partly adjustable. The muscle movement and conditioning achieved by the swimming training apparatus by such conventional devices may only be partially representative of that required for swimming. Most importantly, these conventional devices do not permit the simulation of many different swimming strokes.

It is therefore an object of the present invention to provide an economical swimming training apparatus of the type in question which is fully adjustable to different sizes of persons. It is a further object of the present invention to provide such a device which is safe and comfortable to use, which permits the simulation of many different swimming strokes and which emulates accurately the swimming motion and forces required by a swimmer for those swimming strokes.

SUMMARY OF THE INVENTION

In accordance with the present invention there is provided a swimming training apparatus comprising a frame, a bench secured to the frame to support the torso of a user in generally horizontal position above a supporting surface for the apparatus, lever means, moveable upon movement of the user's legs secured to the frame behind the bench to supportably receive the user's legs, and arm movement means secured to the frame for gripping by the user's hands to permit swimming-like movement of the user's arms. The arm movement means consists of a pair of retractable cords. Hand grip means are secured to one end of each cord and the other end of each cord is secured to a retractable pivotable pulley means. Means are provided to adjust upwardly or downwardly the midsection of the bench with respect to the other parts thereof. The lever means for the user's legs consist of a pair of bars. One end of each bar is secured to the frame behind the bench for pivoting movement about a horizontal axis. Biasing means are associated with each bar so that force is required to move the bar in either pivotal direction. Means are associated with the lever means to cooperate with the user's leg to permit movement of the corresponding bar upon movement of the user's leg.

The apparatus in accordance with the present invention allows the user to simulate the swimming motion of four different strokes; the front crawl, the breast stroke, the back crawl, and the butterfly stroke. It permits muscular endurance training and the development of cardiovascular fitness.

The apparatus in accordance with the present invention is portable and, in a preferred embodiment, is fully adjustable to suit different sizes of persons.

BRIEF DESCRIPTION OF THE DRAWINGS

These and other objects and advantages of the invention will become apparent upon reading the following detailed description and upon referring to the drawings in which.

Figure 1:
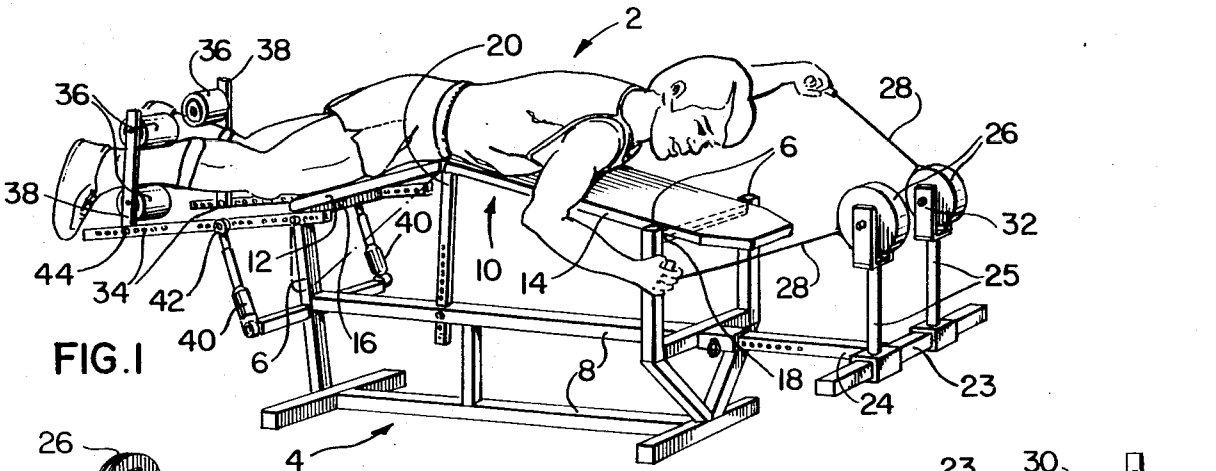
FIG. 1 is a perspective view of a swimming training apparatus in accordance with the present invention.
Figure 2:
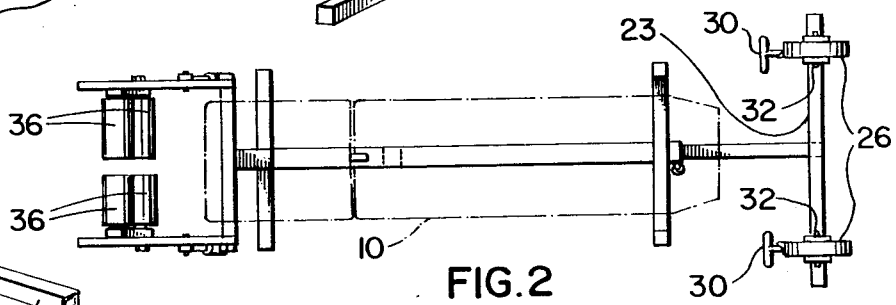
FIG. 2 is a plan view of the apparatus of FIG. 1.
Figure 3:
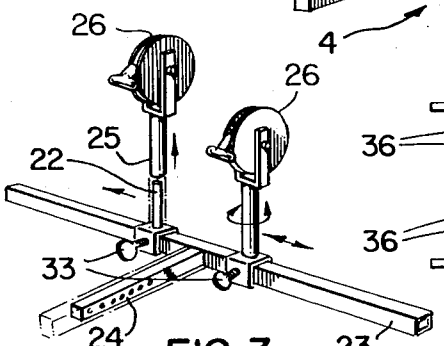
FIG. 3 is a perspective partial view of the front part of the swimming training apparatus of FIG. 1.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1 there is illustrated a swimming training apparatus 2 in accordance with the present invention. The apparatus comprises a frame 4, made of upstanding arms 6 supported on elongated members 8, and a bench 10 supported on arms 6 in generally horizontal fashion. The bench is sectional, with rear and forward sections 12 and 14 respectively supported on transverse bars 16 and 18 so that a central portion of the bench 10 may be elevated or depressed by appropriate adjustment of height of adjustment bar 20 supporting sections 12 and 14 where they join. Adjustment bar 20 is securable at different locations, to one of elongated members 8 as illustrated, to permit this adjustment.

Upstanding posts 22 are secured to bar 23 and then to frame 4 by means of horizontal bar 24, horizontal bar 24 interlocking with upper elongated member 8 so that posts 22 may be longitudinally adjusted closer to or further from the front of bench 10 as illustrated. On each of posts 22 is releasably pivotably mounted, by means of a sleeve 25, a retractable pulley mechanisms 26 comprising a retractable cord or cable 28, at the operative end of which is positioned a hand grip 30. An appropriate tension mechanism 32 may be provided for each retractable pulley 26 so that the force required to withdraw cable 28 from the pulley may be adjusted to suit the requirements of the user. The posts 22 supporting pulleys 26 are adjustably securable at desired positions on bar 23 by sliding lock means 33. This construction enables the pulleys to be positioned and to pivot, as required, for example to enable the proper unobstructed arm movement for each swimming stroke and particularly the breast stroke. As well, because of the fact that vertical posts 22 may be positioned longitudinally with respect to the bench, the retractable pulleys 26 may be positioned to suit the arm length of a user so that a full swimming arm stroke may be emulated by the user.

This construction permits a full range (both recovery and pull through phases) of stroke motion. As well, an S-shaped path of motion for the arm during the pull-through phase of the free-style stroke in swimming is readily emulated, this being regarded as the optimum pattern for propulsion. Making bench 10 relatively narrow and tapered at the front end, as illustrated, facilitates the user's simulating such a swimming pattern.

At the rear of bench 10 is pivotally mounted a pair of lever bars 34 each being independently operable by one of the users legs, as will be described in more detail hereinafter. Each of these lever bars is pivoted to transverse bar 16 so that it extends rearwardly behind bench 10. Cushion rolls 36 are spaced on a bar 38 and secured to each lever bar 34 near free ends to receive, between the rolls, a portion of the lower leg of the user of the device and thereby permit, by appropriate leg movement, the upward or downward pivoting of lever bar 34. A bias against such upward or downward movement is placed on each lever bar 34 by means of a shock 40 secured to and extending between an intermediate portion of each bar 34 and a portion of frame 4. Each of these shocks is preferably a double positive hydraulic shock providing resistance to both upward and downward movement of each bar 34 (flexion and extension leg movement), the bias thereof being adjustable by means of an appropriate adjustment mechanism 42. As well, by means of bolts or other appropriate securing mechanism 44, bar 38 may be appropriately re-positioned along lever bar 34 as suitable for the particular leg length of the user.

Finally, by detaching or appropriately adjusting shock 40 so that lever bars 34 are pivoted downwardly, or by otherwise ensuring the lever bars 34 and cushion rolls 36 are out of the way, a user supported on the bench may practice a whip kick as would be required for strokes such as the breast stroke or certain back strokes.

In the water, the lower body offers only 15 to 30% of the forward propulsion achieved in swimming. The apparatus, in accordance to the present invention with its hydraulic shock system for lower body resistance, actually works the large muscle masses below the user's hip more efficiently than a normal swimming activity. Consequently the user burns more calories and at the same time builds more lower extremity muscular endurance and would be the case in water.

The apparatus according to the present invention, as can be readily understood from the drawings, is extremely simple to construct and, because of its relatively few parts and the interaction of such parts to each other, may be readily assembled and disassembled. This makes the device readily portable.

In using the apparatus according to the present invention, the net overall effect to the user is that of a more balanced upper to lower body endurance program than normal swimming activites can offer.

As well, the apparatus according to the present invention allows an individual who is injured, for example, with "swimmers shoulder" or "supraspinatus tendonitis", which a common overuse malady that may cause a free-style swimmer to stop swimming completely for a period of time, or to train in the water with a different stroke, to train to his fullest pain-free range of motion. The retractable pulleys 26 allow such a person continuous movement in a limited range of motion while at the same time avoiding the position that would cause him the most discomfort, e.g. the mechanical stress at the point of contact when the hand touches the water in the underwater pull sequence.

There are also a large number of athletes that develop overuse types of injuries in bone or muscle structures in their lower extremities. These usually result from problems incurred through weight bearing and shock absorbing activities which occur in running and jumping activities. A large proportion of these injuries could be totally avoided or rehabilitated with a swimming activity which is provided with the apparatus of the present invention. There would be a much lower chance to develop shin splints (posterior tibialis periostitis) or ilio-tibial banditis with a non-weight bearing activity such as provided by the apparatus of the present invention.

This apparatus can also be used as part of a dryland and/or off season program for a competitive swimmer. A prevailing view of athletic coaches is that strength training gains are relatively specific. This means that the improvement to be gained in an athlete is primarily connected with the function being trained; if you want a stronger swimmer you should train activities that resemble the swimming activity. Some researchers also believe that the training should be specific with respect to the speed of movement. The apparatus according to the present invention offers both movement simulation and speed variability and allows the user to train upper muscle groups for endurance by performing certain specific exercises.

The apparatus of the present invention, through a simple bolt or pin system as illustrated, permits a user to easily adjust the machine to his own body size and comfort as follows:

(a) the leg cushion rolls 36 may be moved closer or further away from the bench 10 in response to leg length and to upper body to lower body length ratios; and (b) the mid-section portion of bench 10 may be lowered or raised to place it back in the most comfortable position.

The user can also choose, as has been described hereinbefore, a simple, optionally adjustable upper body resistance and adjustable lower body resistance by means of adjustment mechanisms 32 and 42 for retractable pulleys 26 and hydraulic shocks 40 respectively.

The apparatus according to the present invention offers a simple, inexpensive and space conscious device for emulating swimming and for providing comfortable exercise, for example for home training. It requires no program computers and does not require overly sophisticated machinery while nevertheless providing an efficient apparatus for training.

Thus it is apparent that there has been provided in accordance with the invention a portable, adjustable apparatus for dry land swimming training that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. In a swimming training apparatus comprising a frame, a bench having a mid section area secured to the frame to support the torso of a user in generally horizontal position above a supporting surface for the apparatus, lever means moveable upon movement of the user3 s legs secured to the frame behind the bench to supportably receive the user's legs, arm movement means secured to the frame for gripping by the user's hands to permit swimming-like movement of the user's arms; the improvement characterized by the arm movement means comprising a pair of retractable cords, hand grip means secured to one end of each cord and the other end of each cord retractably secured to a pivotable pulley means, the bench having associated therewith means to adjust upwardly or downwardly the midsection area of the bench with respect to other bench areas thereof to adapt the bench surface to suit the comfort of the user, the lever means comprising a pair of bars, one end of each bar secured to the frame behind the bench for pivoting movement about a horizontal axis, biasing means associated with each bar so that force is required to move the bar in either pivotal direction, and means associated with the lever means to cooperate with the user's legs to permit movement of the corresponding bar upon movement of the user's legs.

2. An apparatus according to claim 1 wherein the leg lever means comprises for each leg an hydraulic shock, each shock secured between the frame and a selected point along the adjacent bar.

3. An apparatus according to claim 1 wherein a pair of padded rolls is associated with each of the bars, the rolls of each pair being spaced from each other sufficiently to comfortably receive therebetween a portion of the user's leg when the user is in position on the bench, to permit movement of the bars upon upward of downward movement of the user's legs.

4. Apparatus according to claim 3 wherein the positioning of each of the pairs of the rolls with respect to its corresponding bar is forwardly and rearwardly adjustable as required to suit the leg length of the user.

5. An apparatus according to claim 1 wherein means are provided whereby the lever means may be pivoted out of the way to permit unobstructed movement of the user's legs when practicing a whip kick.

6. An apparatus according to claim 3 wherein means are provided whereby the lever means and padded rolls may be pivoted out of the way to permit unobstructed movement of the user's legs when practicing a whip kick.

7. An apparatus according to claim 1 wherein the retractable cords are associated with pivotable pulley means secured to a portion of the frame which is adjustable longitudinally with respect to the rest of the frame and bench to properly position the pulley means for a particular user.

8. An apparatus according to claim 7 wherein the pivotable pulley means is provided with adjustable tensioning means for the cordds.

9. An apparatus according to claim 1 wherein the frame comprises an elongated bar supported on a stand, the bar extending longitudinally beneath the bench and having upstanding arms supporting the front and rear portions of the bench, the arm movement means being supported on a upstanding posts for pivoting about vertical axis through said posts, the posts secured to the frame and longitudinally positionable with respect thereto.

10. An apparatus according to claim 9 wherein the bars of the lever means are pivotally secured to portions of the frame supporting the rear of the bench.

11. An apparatus according to claim 1 wherein the bench is sectional, with forward and rear bench sections supported on the frame, and the adjustment means comprises a height adjustment bar secured to the frame and to the sections of the bench.

12. An apparatus according to claim 1 wherein the pulley means are provided with means to permit the pulley means to swivel about a vertical axis during use.

13. An apparatus according to claim 12 wherein the pulley means are further provided with means for laterally adjustably securing the pulley means in position on the frame.

* * * * *